US008974322B1

(12) United States Patent
Jones

(10) Patent No.: US 8,974,322 B1
(45) Date of Patent: Mar. 10, 2015

(54) SHAPED GOLF TEE

(71) Applicant: Brian D. Jones, Tulsa, OK (US)

(72) Inventor: Brian D. Jones, Tulsa, OK (US)

( * ) Notice: Subject to any disclaimer, the term of this patent is extended or adjusted under 35 U.S.C. 154(b) by 0 days.

(21) Appl. No.: 13/942,262

(22) Filed: Jul. 15, 2013

(51) Int. Cl.
*A63B 57/00* (2006.01)

(52) U.S. Cl.
CPC ..... *A63B 57/0018* (2013.01)
USPC ..... 473/387; 473/403

(58) Field of Classification Search
USPC ..... 473/387–403; D21/717
See application file for complete search history.

(56) References Cited

U.S. PATENT DOCUMENTS

| | | | | | |
|---|---|---|---|---|---|
| 1,554,721 | A | | 9/1925 | Getchell | |
| 2,082,811 | A | * | 6/1937 | Thorup | 473/402 |
| 2,839,304 | A | | 6/1958 | Lerick | |
| D252,109 | S | | 6/1979 | Cluggage | |
| 4,192,504 | A | | 3/1980 | Clugage | |
| 4,205,841 | A | * | 6/1980 | Silva et al. | 473/392 |
| D308,086 | S | | 5/1990 | Gamble | |
| 4,951,945 | A | * | 8/1990 | Gamble | 473/400 |
| 5,193,803 | A | | 3/1993 | Flick, III | |
| 5,413,330 | A | * | 5/1995 | Disco et al. | 473/403 |
| D382,930 | S | | 8/1997 | Gorse | |
| 5,683,313 | A | * | 11/1997 | Disco et al. | 473/387 |
| 6,004,228 | A | * | 12/1999 | Adam | 473/403 |
| 6,062,990 | A | * | 5/2000 | Pierce | 473/387 |
| 6,176,794 | B1 | * | 1/2001 | Kim | 473/402 |
| D443,007 | S | * | 5/2001 | Schneider | D21/717 |
| 7,140,982 | B2 | | 11/2006 | Park | |
| 7,833,114 | B2 | | 11/2010 | Schneider | |
| 2006/0223655 | A1 | | 10/2006 | Breton | |
| 2007/0021240 | A1 | * | 1/2007 | Medved | 473/392 |
| 2007/0298909 | A1 | * | 12/2007 | Lu | 473/393 |
| 2010/0173731 | A1 | * | 7/2010 | Schneider | 473/403 |
| 2011/0319198 | A1 | * | 12/2011 | Breton | 473/387 |
| 2012/0064985 | A1 | | 3/2012 | Kumar | |

* cited by examiner

*Primary Examiner* — Steven Wong
(74) *Attorney, Agent, or Firm* — Fellers, Snider, Blankenship, Bailey & Tippens, P.C.

(57) ABSTRACT

A golf tee has a head contoured to balance a golf ball thereon, a point for insertion into a ground surface, and a stem joining the head to the point, the stem providing an enlarged medial portion relative to a proximal portion near the head and a distal portion near the point. The stem has a continuous curvature between the head and the point and joins the head to the point such that the point inserts into the ground surface at an angle that facilities ejection of the tee from the ground surface when the curvature is placed outward relative to a direction of a ball strike force.

20 Claims, 15 Drawing Sheets

SHAPED GOLF TEE

FIELD OF THE INVENTION

This disclosure relates to sporting equipment in general and, more particularly, to golf tees.

BACKGROUND OF THE INVENTION

Traditional golf tees are placed into the ground generally perpendicular to the surface (90 degrees). The golf tee is normally impacted along with the ball when the player takes the swing. The golf tee, under this impact, will bend up to 90°, break, or pop loose from the ground surface. Depending upon the ground surface (hardness, etc), the tee may either bend or push through the soil until it reaches approximately a 25° angle, at which point it has the potential to pop loose from the ground or break, up until it reaches approximately a 65° angle. Popping loose or breaking occurs nominally at around a 45° angle. Thus, depending upon soil composition, the point at which the tee comes loose may be plus or minus up to 20° from the 45° angle. The harder the soil, the more likely the tee will simply break rather than pop loose or be ejected from the ground. If the soil is very soft, the tee may push through the soil rather than popping out.

What is needed is a device for addressing the above, and related, issues.

SUMMARY OF THE INVENTION

The invention of the present disclosure, in one aspect thereof, comprises a golf tee. The golf tee has a head contoured to balance a golf ball thereon, a point for insertion into a ground surface, and a stem joining the head to the point. The stem provides an enlarged medial portion relative to a proximal portion near the head and a distal portion near the point. The stem has a curvature between the head and the point and joins the head to the point such that the point inserts to the ground surface at an angle that facilities ejection of the tee from the ground surface when the curvature is placed outward relative to a direction of a ball strike force.

The medial portion may increase in size from the point upward so as to retard the insertion of the golf tee into the ground surface past the point. In some embodiments, the curve of the medial portion is substantially continuous. The point may enter the ground surface angled toward the direction of the ball strike force. In some embodiments, the point enters the ground surface at about a 45 degree angle when the head is substantially level.

In various embodiments, the medial portion of the stem is circular, polygonal, square, or oval in cross section. In various embodiments the head, point, and stem are formed of a single piece of a polymer, a single piece or wood, or a single piece of metal The invention of the present disclosure, in another aspect thereof, comprises a golf tee with a head for supporting a golf ball, a point for anchoring into a ground surface, and a stem connecting to the head on a proximal portion and connecting to the point on a distal portion. The stein has a curved medial portion that is larger in cross section than the proximal and distal portions. The medial portion is curved so as to provide for the insertion of the point into the ground surface at an angle between about 25° to about 65° degrees when the head is situated to support the golf ball.

In some embodiments, the medial portion increases in size from the point upward so as to retard the insertion of the golf tee into the ground surface past the point. In some embodiments, the medial portion increases in size from the head downward. The curve of the medial portion may present a concave surface profile to the direction from which a golf club swing approaches. The point may enter the ground surface angled to the direction from which the golf club swing approaches.

The invention of the present disclosure, in another aspect thereof, comprises a golf tee with a bowed stem having a cross sectional area that is greater along a medial portion than along a proximal portion and a distal portion. The tee comprises head formed on the proximal portion and adapted to resting a golf ball for striking, and a point formed on the distal portion and having an angle relative to the head such that the point inserts into a ground surface at about a 45 degree angle when the head is substantially level. The bow in the stem is away from a direction of a strike force to allow the tee to be ejected from the ground surface with minimal chance for damage from the strike force.

The stem may be polygonal in cross section along at least a portion of a length thereof. The stem may present a smooth curve in cross section along at least a portion of a length thereof.

BRIEF DESCRIPTION OF THE DRAWINGS

FIG. 13 is a superior view of the golf tee of FIG. 11.

FIG. 15 is a perspective view of the golf tee of FIG. 11.

DETAILED DESCRIPTION OF THE PREFERRED EMBODIMENTS

Figure 1:
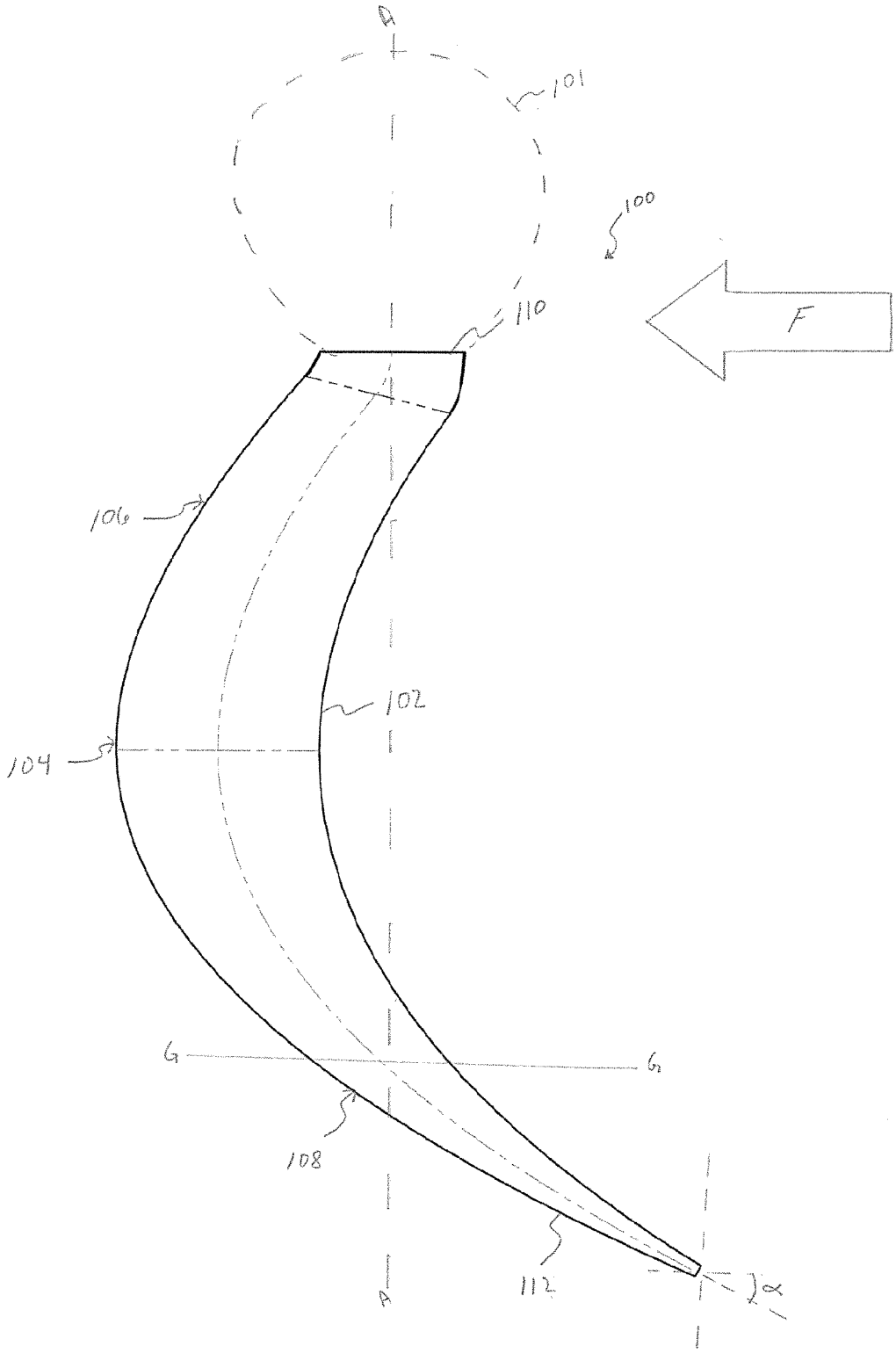
FIG. 1 is a side view of one embodiment of a golf tee according to aspects of the present disclosure.

Referring now to FIG. 1, a side view of one embodiment of a golf tee according to aspects of the present disclosure is shown. The golf tee 100 comprises a curved stem 102 having a medial portion 104, a proximal portion 106, and a distal portion 108. The curvature of the stem 102 is continuous in the present embodiment, but this is not required. For example, the stem 102 may comprise one or more substantially straight portions joined by one or more bends or kinks. Among those embodiments having a continuous curvature, radius of the curvature may vary. It can be seen though that in the present embodiment, the stem 102 is generally non-axial with an axis A-A running though the center of a golf ball 101 (mounted on the tee 100) and down to the ground surface G-G. In the present embodiment, the golf tee 100 has a circular cross-section. However, as can be seen from the various figures, the cross-sectional area may not be constant.

The proximal portion 106 terminates in, or is otherwise attached to, a head 110. The head 110 is configured to support a golf ball for striking. In the present embodiment, the golf tee 100 will be oriented such that the force of a club face striking a supported ball will be from the direction denoted by the arrow "F". In the present embodiment, the curvature of the stem 102 is generally away from this direction of force. Stated another way, it presents a concave profile to the force "F" and a convex profile away from the force "F".

The distal portion 108 is attached to, or terminates in, a point 112. The point 112 may be narrower than the remainder of the distal portion 108 and/or medial portion 104. The point 112 is configured to be sharp or pointed enough to insert into the ground for mounting the tee 100. Although the depth to which the point 112 and/or distal portion 108 are inserted into the ground may vary, a line G-G is shown in FIG. 1 to illustrate one potential depth of placement.

The overall shape and cross-section of the stem 102 and its constituent portions may be such that when the head 110 is substantially level to the ground, the point 112 is inserted into the ground at a particular angle of descent, α. In some embodiments, the angle α may be approximately 45° relative to the ground surface. In other embodiments, the angle may vary from about 25° to about 65°. The angle α may vary depending upon soil conditions, turf, club configuration, and even player style to optimize the benefits of using the tee 100 (such as improved release from the ground surface). However, it will be appreciated that even where the angle α is not totally ideal for the conditions or player, the golf tee 100 will still be advantageous over those of the prior art.

The distal portion 108 and the point 112 deviate from a traditional perpendicular orientation for the point of a golf tee. Accordingly, a particular direction must be chosen for proper use of a golf tee such as the golf tee 100 of FIG. 1. As described above, the golf tee 100 operates most effectively when the curvature of the stem 102 is generally away from this direction of force "F". In other words the point 112 and the head 110 are both "pointed" toward the golf club head as it comes in for the swing, as compared to the medial portion 104 of the stem 102.

Under impact, the angle α of the point 112 will allow the golf tee 100 to easily "pop loose" or eject from the ground surface under force of the club impact. In such manner, there is less chance that the impact or ball flight will be disturbed due to stresses and strains imparted to the ball and/or club face by the golf tee. Furthermore, the golf tee 100 is much less prone to damage than a traditional design as it is configured to easily release from the ground surface at approximately the same angle that golf tees are normally violently driven from the ground.

The golf tee 100 also provides a larger surface area on the stem 102 relative to a traditional stem. Such a design is easier to grasp or manipulate for insertion into the ground surface. The additional surface area may also be useful for decoration or advertisement. It can also be seen that the point 112 and the distal portion 108 are much narrower than the medial portion 104. The degree of taper between the point 112, the distal portion 108, and the medial portion 104 can vary depending on the embodiment to provide a degree of increasing resistance as the tee 100 is driven into the ground. In this manner, over insertion of the tee 100 is less likely. Some embodiments will also provide for graduations or markings on the point 112, the distal portion 108, and/or the medial portion 104 that will indicate ideal depth for placement of the golf tee 100.

As the medial portion 104 may be thicker or wider than the distal portion 108 and/or the point 112, it may also be larger or thicker than the proximal portion 106 and/or the head 110. In this manner, the overall structural integrity of the golf tee 100 can be increased while still providing a relatively small and unobtrusive head 110 for placement of the golf ball. Generally, a golf ball does not need a particularly large platform in order to be stable and any platform larger than necessary or convenient may actually be detrimental to a golfer's game. Thus, the overall dual tapered design of the golf tee 100 allows all of the aforementioned benefits and avoids any potential pitfalls.

Figure 2:
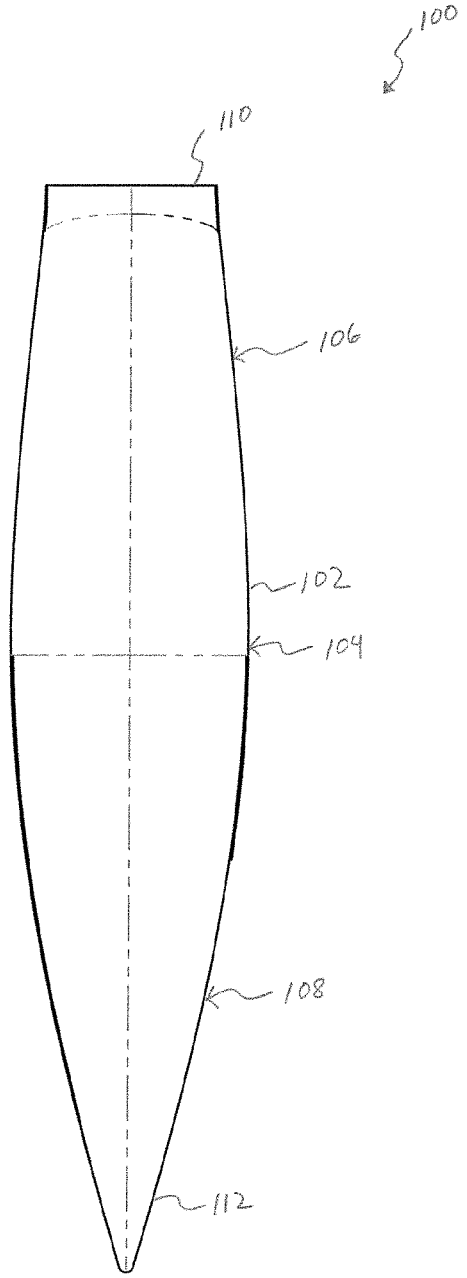
FIG. 2 is a frontal view of the golf tee of FIG. 1.

Referring now to FIG. 2, a frontal view of the golf tee 100 of FIG. 1 is shown. Here, it can be seen that, looking toward the direction of the club strike as shown in FIG. 1, the profile of the stem 102 is generally convex. From top to bottom, the tapering profile from the head 110 to the proximal portion 106 and through the medial portion 104 to the distal portion 108 and the point 112 can be seen. With reference to FIGS. 1 and 2, it can be seen that the golf tee 100, at its widest point, is not particularly wider than the head portion 110. Thus, the item is not particularly large or bulky relative to a traditional tee, yet provides the distinct advantages previously discussed. It should be understood that FIGS. 1 and 2, however, are only exemplary. Other embodiments may feature tees with wider stems relative to the head.

Figure 3:
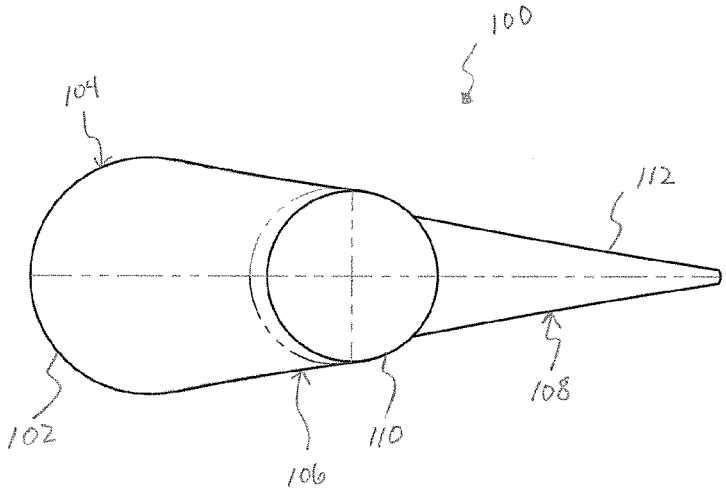
FIG. 3 is a superior view of the golf tee of FIG. 1.

Referring now to FIG. 3, a superior view of the golf tee 100 of FIG. 1 is shown. Once again, the degree of curvature and taper of the stem 102 can be seen with the point 112 being towards the direction of an incoming club strike. It will be appreciated that, to the extent that any high impact forces are imparted to the golf tee 100, they will primarily be absorbed by the widest medial portion 104 of the stem 102, thus further reducing the likelihood of damage or breaking of the golf tee 100.

Figure 4:
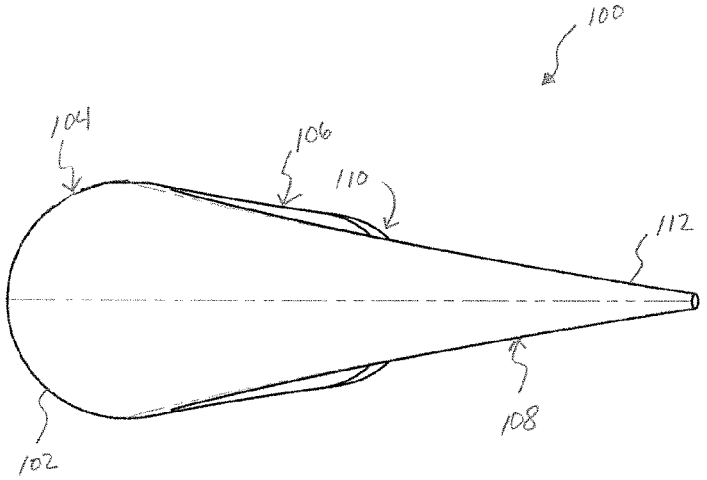
FIG. 4 is an inferior view of the golf tee of FIG. 1.

Referring now to FIG. 4, an inferior view of the golf tee 100 of FIG. 1 is shown. From this viewpoint, it can be seen that, although the distal portion 108 and the proximal portion 106 both taper relative to the medial portion 104, the degree of taper towards the distal portion 108 is greater in the present embodiment than the degree of taper of the proximal portion 106. This allows for easier insertion of the point 112 into the ground surface. However, as previously described, the degree of taper of the distal portion 108 and the proximal portion 106 may vary depending upon the particular embodiment.

Figure 5:
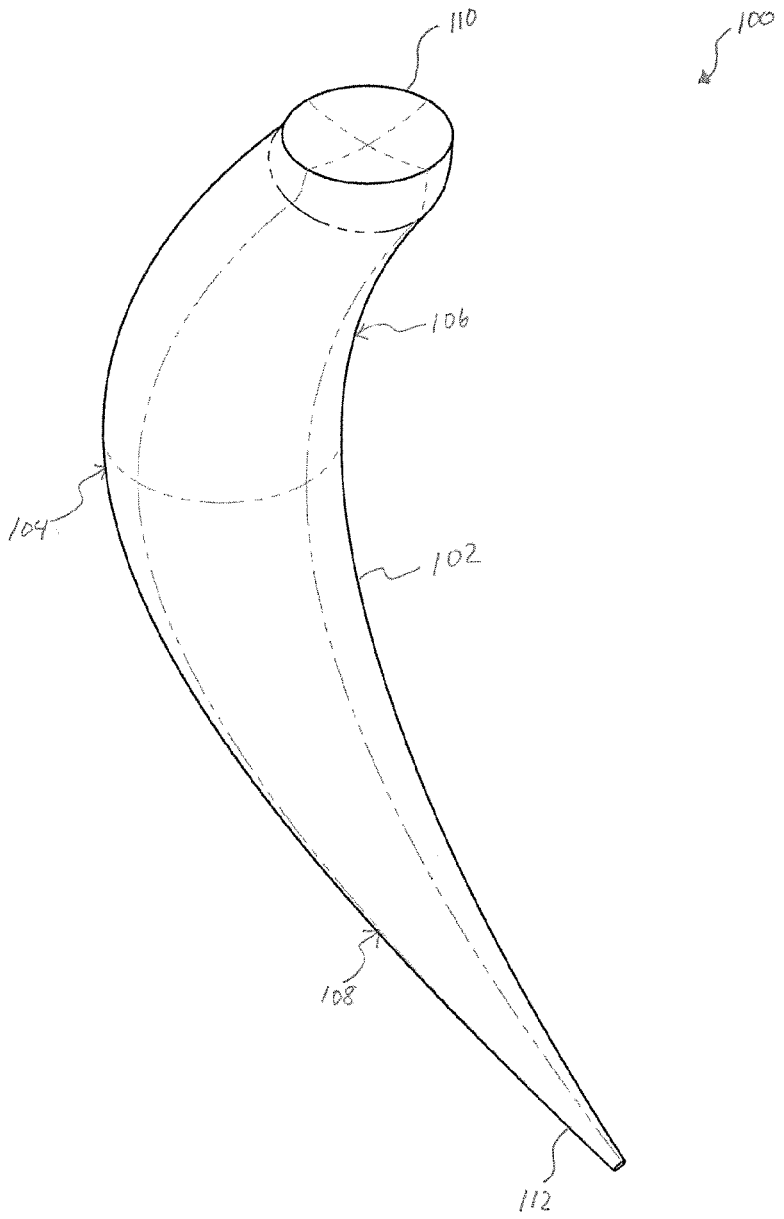
FIG. 5 is a perspective view of the golf tee of FIG. 1.

Referring now to FIG. 5, a perspective view of the golf tee 100 is shown. From this three-dimensional view, it can be appreciated that the head 110 provides a certain amount of concavity for supporting a golf ball. This prevents a golf ball from rolling off of the head 110. In the present embodiment, the stem 102 forms a continuous piece with the head 110 and the point 112. It will be appreciated that such an embodiment may be manufactured by molding of a polymer or a metal or by various machining techniques adaptable for use with polymers and/or metals. Furthermore, the golf tee 100 may comprise a carved wood. Although the present embodiment is formed of a unitary piece, it will be appreciated that other embodiments could have components manufactured separately and glued or otherwise affixed together.

Figure 6:
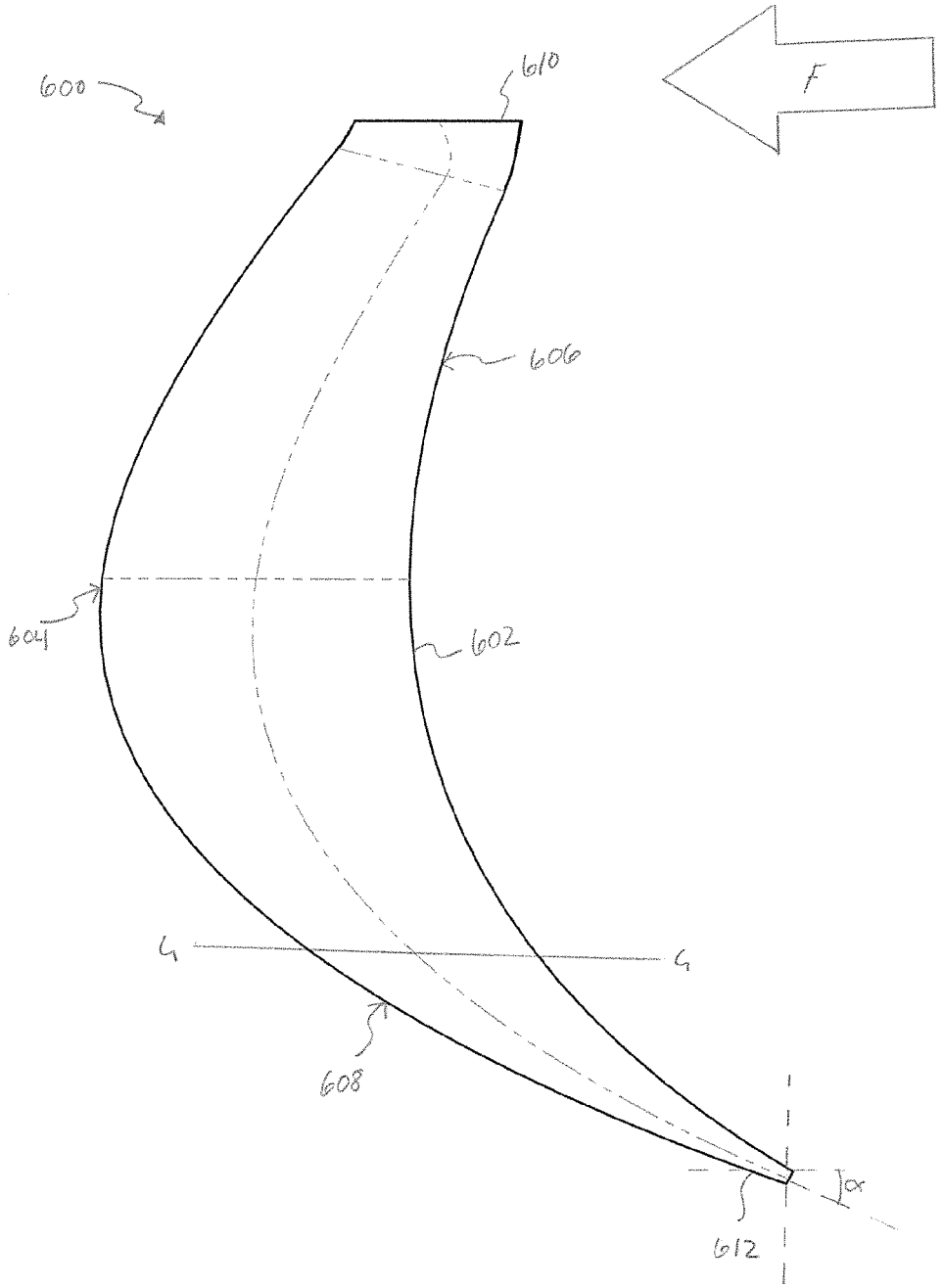
FIG. 6 is a side view of another embodiment of a golf tee according to aspects of the present disclosure.

Referring now to FIG. 6, a side view of another embodiment of a golf tee according to aspects of the present disclosure is shown. There are similarities between the golf tee 600 and the golf tee 100 previously discussed, but there are also some differences which will be discussed herein. The golf tee 600 comprises a stem 602 having a medial portion 604, a proximal portion 606, and a distal portion 608. In the present embodiment, the proximal portion 606 terminates in a head 610 adapted to support a golf ball. The distal portion 608 terminates in a point 612 for anchoring the golf tee 600 into a ground surface.

As with previous embodiments, the stem 602 provides a curvature that allows the point 612 to be inserted into the ground surface at a particular angle, α, when the head 610 is substantially perpendicular to the ground surface. In the present embodiment, the angle α is approximately 45° relative to vertical or horizontal (e.g., the ground surface). Again, the angle α is may vary from 45° by up to about 20°.

The golf tee 600 will be oriented with the point 612 facing towards the direction of force "F" of a golf swing. The 45° angle of the point 612 relative to the ground surface allows the golf tee 600 to be ejected from the ground surface in response to the force "F" while minimizing the chance that the golf tee 600 will become damaged. In the event that the golf tee 600 does absorb a substantial force impact, this will generally be borne by the medial portion 604, which is the largest or thickest portion of the stem 602. The stem 602 generally narrows or tapers towards the distal portion 608 and/or the point 612. It also tapers towards the proximal portion 606 and/or the head 610. Here, the cross section of the stem 602 is generally oblong or oval.

Figure 7:
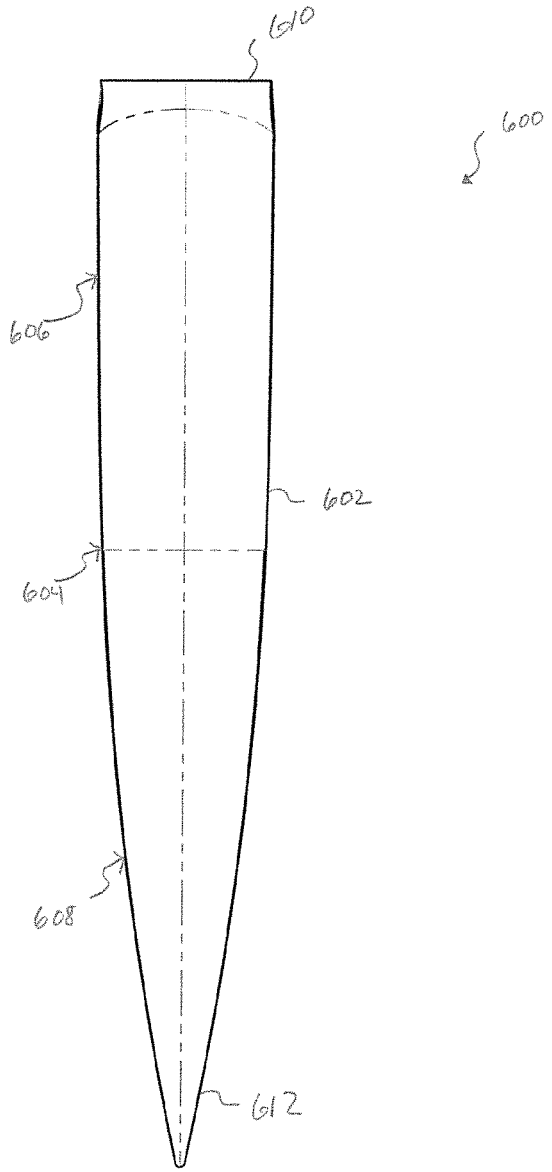
FIG. 7 is a frontal view of the golf tee of FIG. 6.

Referring now to FIG. 7, a frontal view of the golf tee 600 of FIG. 6 is shown. In the present embodiment, the frontal view reveals a taper of the stem 602 that is generally narrowing from the proximal portion 606 through the medial portion 604 and down to the distal portion 608. Note that the frontal view of FIG. 7 shows a slightly different profile from that just discussed in FIG. 6. This may be a choice of aesthetics or function of the golf tee 600. From the frontal view of FIG. 7, the stem 602 is never appreciably wider than the head 610.

Figure 8:
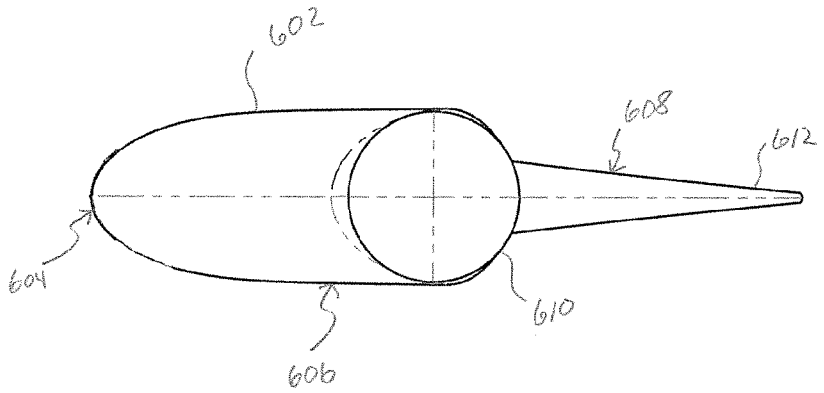
FIG. 8 is a superior view of the golf tee of FIG. 6.
Figure 9:
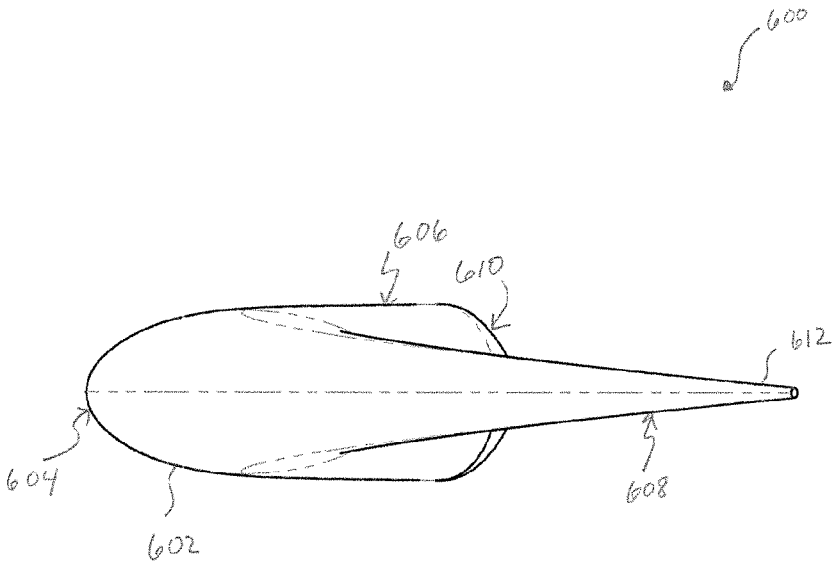
FIG. 9 is an inferior view of the golf tee of FIG. 6.

Referring now to FIG. 8, a superior view of the golf tee 600 of FIG. 6 is shown. From the superior view of FIG. 8, it can be appreciated that the overall taper of the stem 602 is generally narrowing, once again, from the proximal portion 606 through the medial portion 604 and down to the distal portion 608. Referring now also to the inferior view of FIG. 9, the taper of the present embodiment can once again be seen. In some respects, the overall shape of the golf tee 600 when viewed directly from the superior and inferior viewpoints is that of a curved cone or horn.

Figure 10:
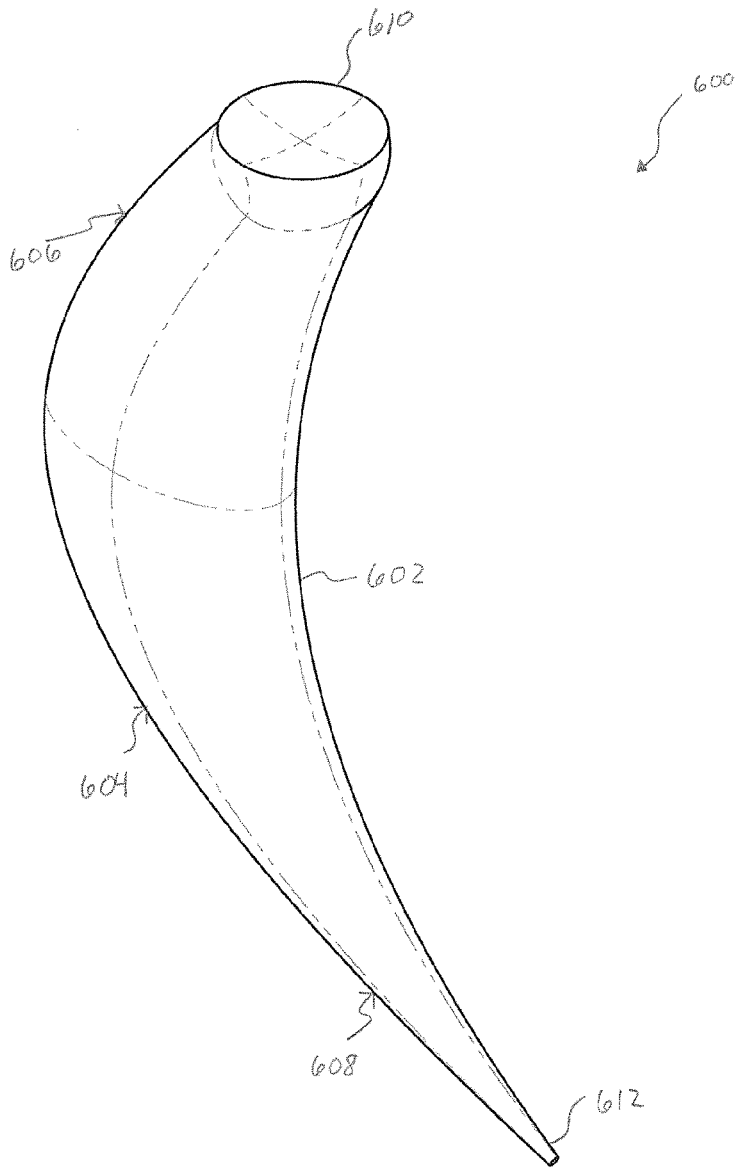
FIG. 10 is a perspective view of the golf tee of FIG. 6.

Referring now to FIG. 10, a perspective view of the golf tee of FIG. 6 is shown. From this viewpoint, it can be appreciated that the present embodiment may appear slightly different depending upon the angle of viewing. For example, when viewed in profile in FIG. 6, a noticeable taper from the medial portion 604 to the proximal portion 606 can be seen, but this taper is not observed in the inferior, superior, and frontal views. Thus, with reference to FIG. 10, the overall three-dimensional shape of the golf tee 600 can be seen. As with previous embodiments, the shape of the golf tee 600 can be achieved by molding or machining various materials such as polymers, metals, or wood. As before, the stem 602 provides an increased surface area for decoration or advertisement relative to a traditional golf tee. Also, as before, graduations or markings may be provided on the distal portion 608 and/or the medial portion 604 to indicate an ideal depth of placement of the golf tee 600.

Figure 11:
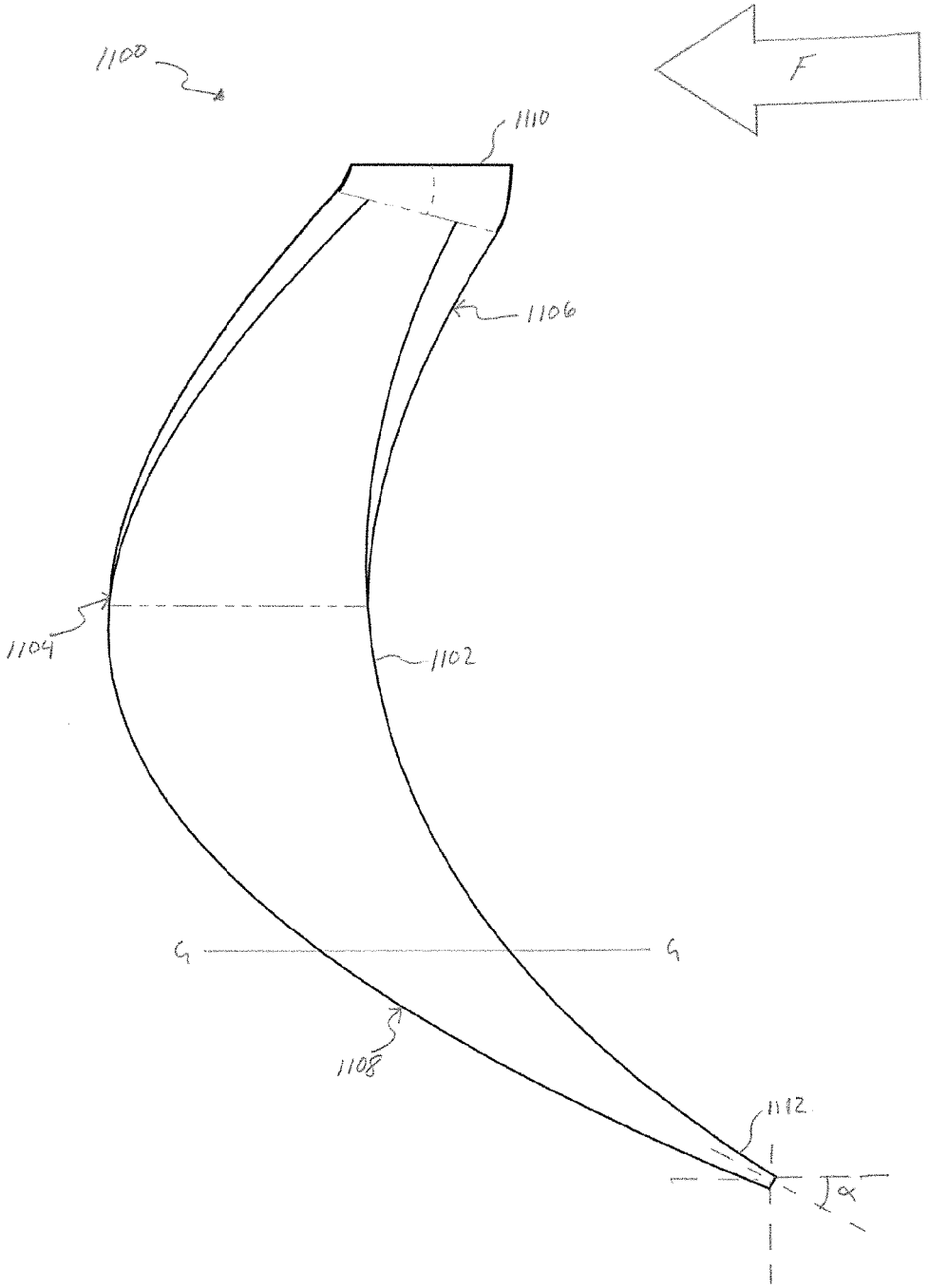
FIG. 11 is a side view of a third embodiment of a golf tee according to aspects of the present disclosure.

Referring now to FIG. 11, a side view of a third embodiment of a golf tee according to aspects of the present disclosure is shown. As before, there are some similarities and differences between the golf tee 1100 and those previously discussed (100, 600). The golf tee 1100 comprises a curved stem 1102 that tapers in side profile from a relatively large medial portion 1104 to a narrower proximal portion 1106 and a narrower distal portion 1108. The distal portion 1108 terminates in a point 1112 for anchoring the golf tee 1100 into a ground surface. The proximal portion 1106 terminates in a head 1110 adapted to retain a golf ball for striking. In the present embodiment, the stem 1102 is generally curved such that the point 1112 may be inserted into the ground surface at a particular angle, α, when the head 1110 is substantially level with the ground surface. In the present embodiment, the angle α is approximately 45° (+/−about 20°).

As with previous embodiments, the point 1112 and the head 1110 are to be facing towards a direction of force "F" from which the ball will be struck. In this manner, any forces acting upon the golf tee 1100 to drive it or remove it from the ground will be substantially less likely to damage the golf tee 1100 relative to a traditional straight stemmed design. As can be appreciated in figures discussed below, the general cross section of the stem 1102 of the golf tee 1100 is that of a polygon, in the present case, a square.

Figure 12:
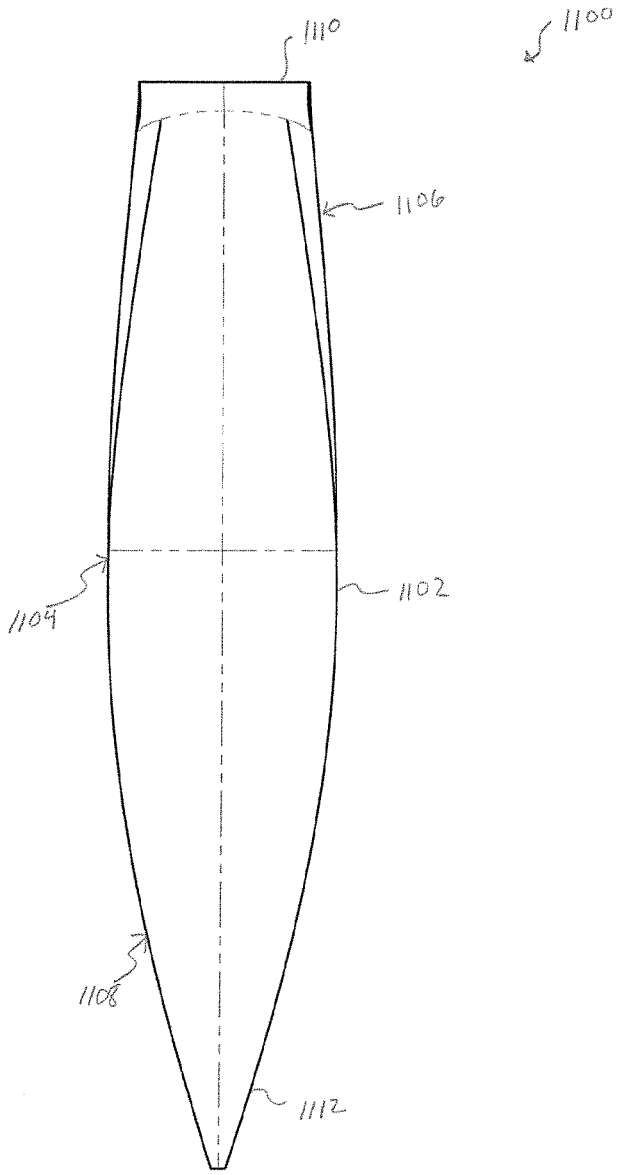
FIG. 12 is a frontal view of the golf tee of FIG. 11.
Figure 23:
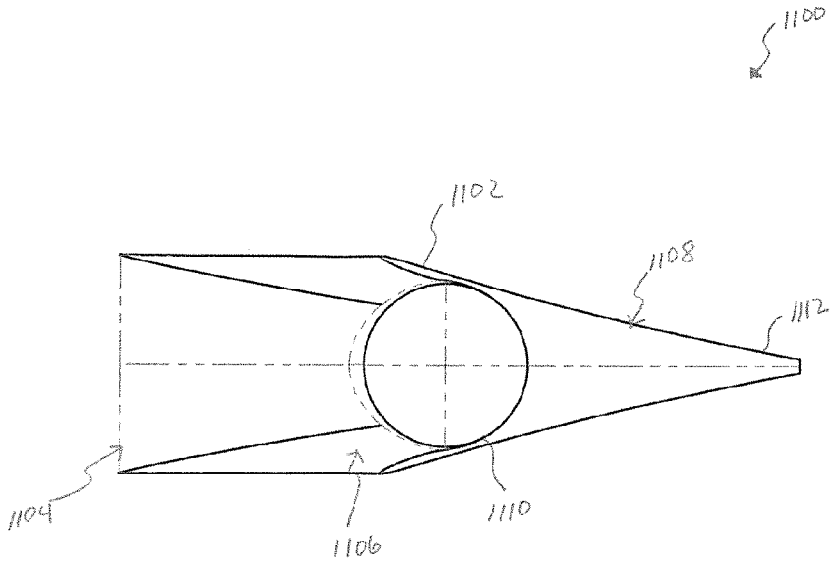

Referring now to FIG. 12, a frontal view of the golf tee of FIG. 11 is shown. Here, it can be seen that the golf tee 1100 features a taper from the medial portion 1104 to the proximal portion 1106 and also to the distal portion 1108. Once again, the stem 1102 narrows both toward the head 1110 and the point 1112.

Referring now to FIG. 13, a superior view of the golf tee 1100 of FIG. 11 is shown. From the viewpoint of FIG. 13, the overall squareness of the cross section of the proximal portion 1106 can be seen. However, it can also be seen that the head 1110 is still configured in a circular concave configuration. This allows for a traditional seating of the golf ball on the head 1110 while allowing the remainder of the golf tee 1100 to retain the square cross section design.

Figure 14:
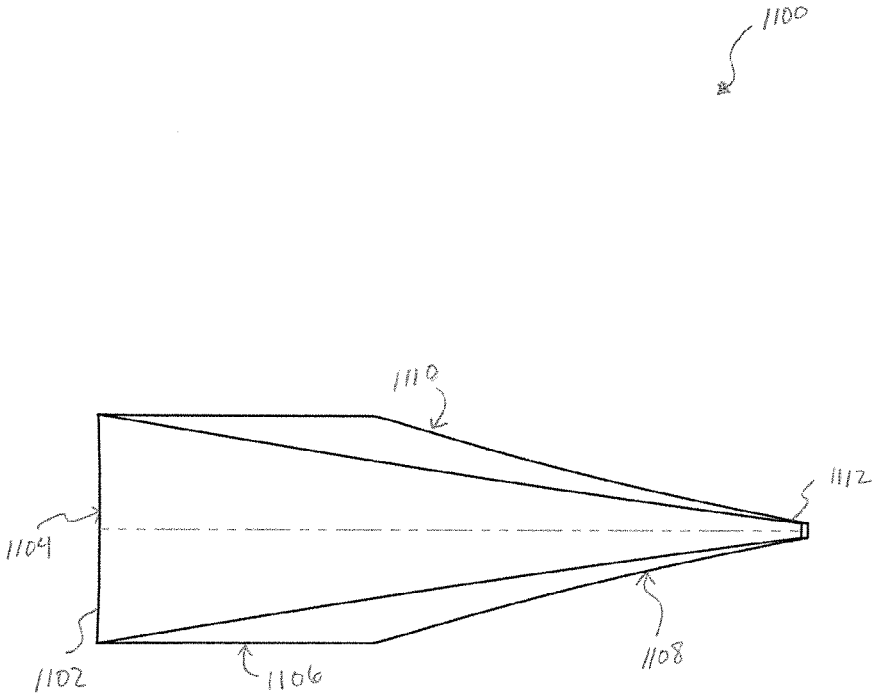
FIG. 14 is an inferior view of the golf tee of FIG. 11.
Figure 25:
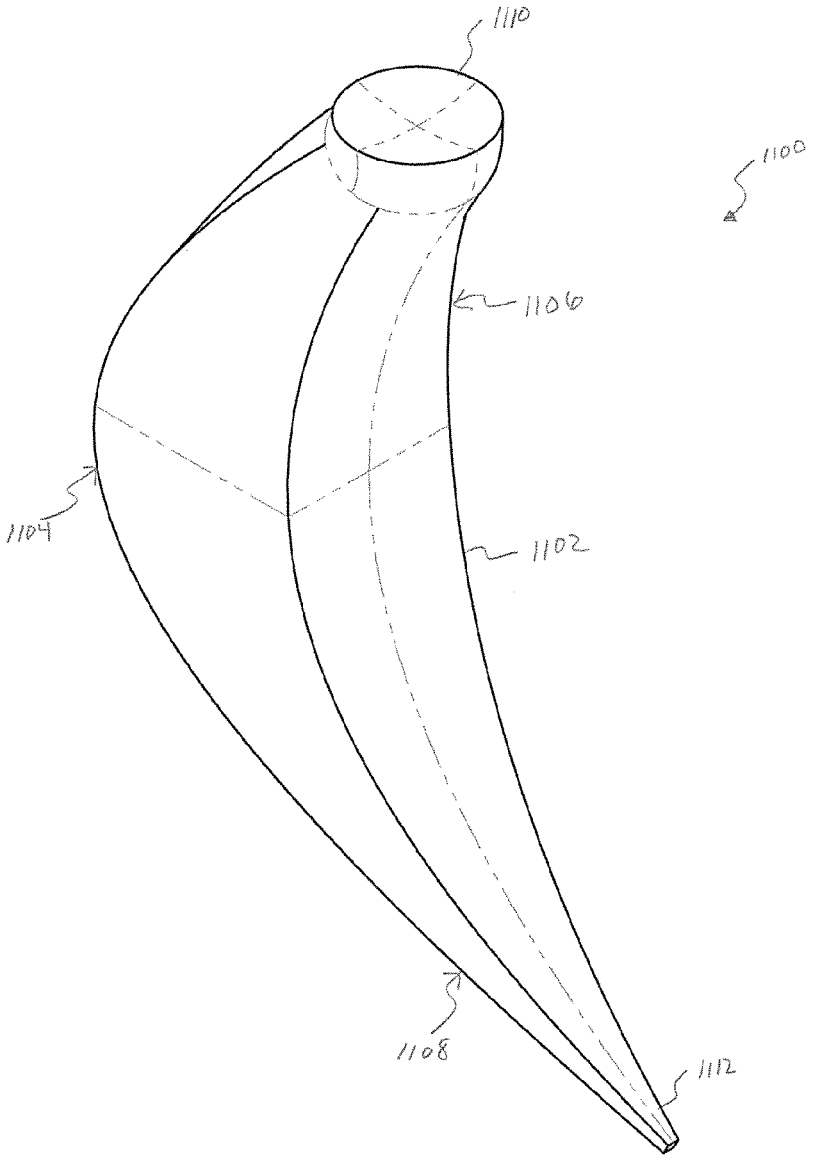

Referring now to FIG. 14, an inferior view of the golf tee 1100 of FIG. 11 is shown. From this viewpoint, it can be appreciated that the distal portion 1108 also features a tapered square cross section. In the present embodiment, the point 1112 may also terminate in a squared off end. The point 1112 does not need to be particularly sharp, so long as it provides for ease of entry of the golf tee 1100 into the ground surface.

Referring now to FIG. 15, a perspective view of the golf tee 1100 of FIG. 11 is shown. From the viewpoint of FIG. 15, it can be appreciated, once again, that the golf tee 1100 tapers from a relatively large square cross section in the medial portion 1104 to a narrowing square cross section in the proximal portion 1106 and in the distal portion 1108. Here, the rounded and concave head 1110 can be seen atop the square proximal portion 1106.

In the embodiment of FIG. 15, as with the previous embodiments, the head 1110 and the point 1112 are both angled toward the user or direction of force relative to the medial portion 1104. Once again, this provides that any impact forces absorbed by the golf tee 1100 are likely to be borne by the strongest portion of the tee, in this case, the medial portion 1104. The tapering and pointed end point 1112, at the 45° angle (+/−about 20°) previously discussed, also allows the golf tees, such as 1100, to easily eject from a ground surface without sustaining damage. As with previous embodiments, the additional surface area, particularly the squared sides of the golf tee 1100, provide additional room for decoration and/or advertisement. Furthermore, as with previous embodiments, a portion of the distal portion 1108 and/or the medial portion 1104 can be marked or graduated to provide for an ideal depth of placement in the ground surface.

It will be appreciated that with the embodiments of the present disclosure (e.g., golf tees 100, 600, 1100) less resistance is encountered by the club face due to the force normally taken to drive the golf tee out of or through the ground. This results in increased yardage per stroke. Furthermore, each of the embodiments discussed has a stem (e.g., 104) that is bowed away from the vertical axis of the ball (e.g., A-A of FIG. 1). Thus, when a modern driver (which has a noticeably deeper or taller face compared to drivers in the past—those available when standard tees were created) is coming in contact with the ball on the upswing it is less likely that the lower edge of the club face will strike the tee prior to, or simultaneously to, hitting the ball. This further decreases the chance that contact with the tee will alter the trajectory of the ball. Yardage will also be increased from lack of or delayed, contact with the tee by the club face.

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the spirit of this invention as defined by the claims.

What is claimed is:

1. A golf tee comprising:

a head contoured to balance a golf ball thereon;

a point for insertion into a ground surface;

a stem joining the head to the point, the stem providing an enlarged medial portion relative to a proximal portion near the head and a distal portion near the point;

wherein the stem has a curvature between the head and the point and joins the head to the point such that the point inserts to the ground surface at an angle between about 25 to 65 degrees when said head is oriented to balance a golf ball that facilities ejection of the tee from the ground surface when the curvature is placed outward relative to a direction of a ball strike force.

2. The golf tee of claim 1, wherein the medial portion increases in size from the point upward so as to retard the insertion of the golf tee into the ground surface past the point.

3. The golf tee of claim 1, wherein the curve of the medial portion is substantially continuous.

4. The golf tee of claim 3, wherein the point enters the ground surface angled toward the direction of the ball strike force.

5. The golf tee of claim 1, wherein at least the medial portion of the stem is circular cross section.

6. The golf tee of claim 1, wherein at least the medial portion of the stem is polygonal in cross section.

7. The golf tee of claim 3, wherein at least the medial portion of the stem is square in cross section.

8. The golf tee of claim 1, wherein at least the medial portion of the stem is oval in cross section.

9. The golf tee of claim 1, wherein the point enters the ground surface at about a 45 degree angle when the head is substantially level.

10. The golf tee of claim 1, wherein the head, point, and stem are formed of a single piece of a polymer.

11. The golf tee of claim 1, wherein the head, point, and stem are formed from a single piece of wood.

12. The golf tee of claim 1, wherein the head, point, and stem are formed from a single piece of metal.

13. A golf tee comprising:

a head for supporting a golf ball;

a point for anchoring into a ground surface;

a stem connecting to the head on a proximal portion and connecting to the point on a distal portion;

wherein the stem has a curved medial portion that is larger in cross section than the proximal and distal portions; and wherein the medial portion is curved so as to provide for the insertion of the point into the ground surface at an angle between about 25° to about 65° degrees when the head is situated to support the golf ball.

14. The golf tee of claim 13, wherein the medial portion increases in size from the point upward so as to retard the insertion of the golf tee into the ground surface past the point.

15. The golf tee of claim 13, wherein the medial portion increases in size from the head downward.

16. The golf tee of claim 13, wherein the curve of the medial portion presents a concave surface profile to the direction from which a golf club swing approaches.

17. The golf tee of claim 16, wherein the point enters the ground surface angled to the direction from which the golf club swing approaches.

18. A golf tee comprising:

a bowed stem having a cross sectional area that is greater along a medial portion than along a proximal portion and a distal portion;

a head formed on the proximal portion and adapted to resting a golf ball for striking;

a point formed on the distal portion and having an angle relative to the head such that the point inserts into a ground surface at about a 45 degree angle when the head is substantially level; and wherein the bow in the stem is away from a direction of a strike force to allow the tee to be ejected from the ground surface with minimal chance for damage from the strike force.

19. The golf tee of claim 18, wherein the stem is polygonal in cross section along at least a portion of a length thereof.

20. The golf tee of claim 18, wherein the stem presents a smooth curve in cross section along at least a portion of a length thereof.

* * * * *